US007500859B2

(12) United States Patent
Dubranna

(10) Patent No.: US 7,500,859 B2
(45) Date of Patent: Mar. 10, 2009

(54) ELECTRICAL CONNECTOR CONNECTABLE IN WATER OR IN A LIQUID MEDIUM

(75) Inventor: Pierre Dubranna, Nuille le Jalais (FR)

(73) Assignee: Carrier Kheops BAC, Le Mans (FR)

( * ) Notice: Subject to any disclaimer, the term of this patent is extended or adjusted under 35 U.S.C. 154(b) by 0 days.

(21) Appl. No.: 11/792,916

(22) PCT Filed: Dec. 22, 2004

(86) PCT No.: PCT/FR2004/003337

§ 371 (c)(1),
(2), (4) Date: Jan. 4, 2008

(87) PCT Pub. No.: WO2006/070078

PCT Pub. Date: Jul. 6, 2006

(65) Prior Publication Data

US 2008/0153333 A1 Jun. 26, 2008

(51) Int. Cl.
*H01R 13/44* (2006.01)

(52) U.S. Cl. ..... 439/140

(58) Field of Classification Search ..... 439/140, 439/201, 271, 205, 276
See application file for complete search history.

(56) References Cited

U.S. PATENT DOCUMENTS 4,142,770 A 3/1979 Butler, Jr. et al.
4,795,359 A * 1/1989 Alcock et al. ..... 439/271

FOREIGN PATENT DOCUMENTS

EP 0 251 655 * 1/1988
EP 0 493 375 A2 7/1992

* cited by examiner

*Primary Examiner*—Javaid Nasri
(74) *Attorney, Agent, or Firm*—Sughrue Mion, PLLC

(57) ABSTRACT

An underwater electrical connector having an electrically insulated contact chamber (21) receiving a pin (5) of a male coupling element in a contact area (41). A piston element (29) and the contact pin (5) slide in the contact chamber (21) in a sealingly connectable manner by at least two joints, one (45) placed near an opening (27) and the other (45') downstream of the pin and the contact chamber contact area (9, 41). The surface of the piston element (29) between the two joints (45, 45') is connected to a chamber filled with an electrically insulating fluid (49), arranged inside the connector element and connected to an external flexible wall element (51) deformable so as allow the introduction and removal of the contact pin (5). The contact area is filled with the electrically insulating fluid and separated from the remaining part of the connector by a third joint (47).

14 Claims, 2 Drawing Sheets

ELECTRICAL CONNECTOR CONNECTABLE IN WATER OR IN A LIQUID MEDIUM

FIELD OF THE INVENTION

The invention relates to an electrical connector that can be connected in water or in a liquid medium and in particular, an electrical connector that can be connected in sea water.

BACKGROUND OF THE INVENTION

Patents EP 0 493 375 and EP 0 251 655 disclose electrical connectors that can be connected in sea water, comprising two expansion chambers containing an electrically insulating fluid for drying the contact part of the connector when the male element of the connector is coupled in the corresponding female element, the external expansion chamber forming the body of the casing of the female connector element. However, this external, deformable expansion chamber mainly comprises a wall made of elastomer material, the external surface of which can be attacked by solvents, particularly in the case of oil drilling. Furthermore, the mobile shuttle receiving the contact pin of the male element is returned toward the front of the female element by means of a helical spring housed in the rear part of the shuttle housing. This arrangement makes it complicated to construct, particularly when it comprises multiple contact elements, and increases the coupling force in proportion to the number of contact elements.

SUMMARY OF PREFERRED EMBODIMENTS OF THE INVENTION

The invention aims to remedy these drawbacks and proposes an electrical connector connectable in water or in a liquid medium, comprising two complementary connector elements, respectively a male element and a female element intended to be coupled together in service in said liquid medium, the male connector element comprising at least one contact pin projecting from the connector element, and the female connector element comprising at least one opening for the pin to pass through to couple said connector elements, this opening being blocked in the uncoupled position by an electrically insulating piston element fitted to slide inside the connector element in an electrically insulating rigid contact chamber, which receives via a contact area the contact pin of the male connector element on coupling, the piston element and the contact pin also sliding in a sealed manner on coupling into the contact chamber via at least two axially separate seals, one of which is located close to said opening and the second being located downstream of the contact area of the pin and of the contact chamber with respect to the opening, the surface of the piston element between the two seals being linked to a chamber filled with electrically insulating fluid, formed inside the connector element, this chamber being linked to an external flexible wall element that deforms to accept the insertion or removal of the contact pin into or from the contact chamber, in respective connector coupling and uncoupling operations, the contact area also being filled with electrically insulating fluid and separated from the rest of the connector by a third seal provided on the piston element or in the contact chamber.

The result of this arrangement is that the female connector element can comprise a rigid external body made of material that is insensitive to solvents.

The external deformable flexible wall element, sensitive to solvents, can, however, be fitted so as to be exchangeable.

The coupling contact area of the pin and of the contact chamber can be formed by a front part of the contact chamber, receiving in service the active conductive part of the pin, at the front of the latter, for example, through a set of annular cells clamped on the active conductive part of the pin.

The piston element is fitted returned towards the front, at the edge of the opening of the connector element, advantageously, by a spring means positioned at the rear of the piston element around the contact chamber, which is sheathed by an electrical insulator over all its surface area apart from the contact area.

With this arrangement, this spring means can also be used, for example by a common end strand, to return other piston elements of contact chambers of other contacts arranged in the connector element, in the case of connectors with multiple contacts, as schematically illustrated in FIG 3.

Naturally, the rear part of the contact chamber, not contained by the piston element, is also filled with electrically insulating fluid, via an appropriate hole through its wall. Also, a drying seal element positioned between the wall of the piston element and the contact chamber is fitted on the periphery of the piston element or in an appropriate position in the contact chamber upstream of the contact area relative to the opening, to separate the contact area filled with electrically insulating fluid from the contact chamber and avoid any trace of water or external liquid medium in the contact area on coupling.

BRIEF DESCRIPTION OF THE DRAWINGS

The invention is illustrated below by an exemplary embodiment and with reference to the appended drawings, in which.

DETAILED DESCRIPTION OF EXEMPLARY EMBODIMENTS

Figure 1:
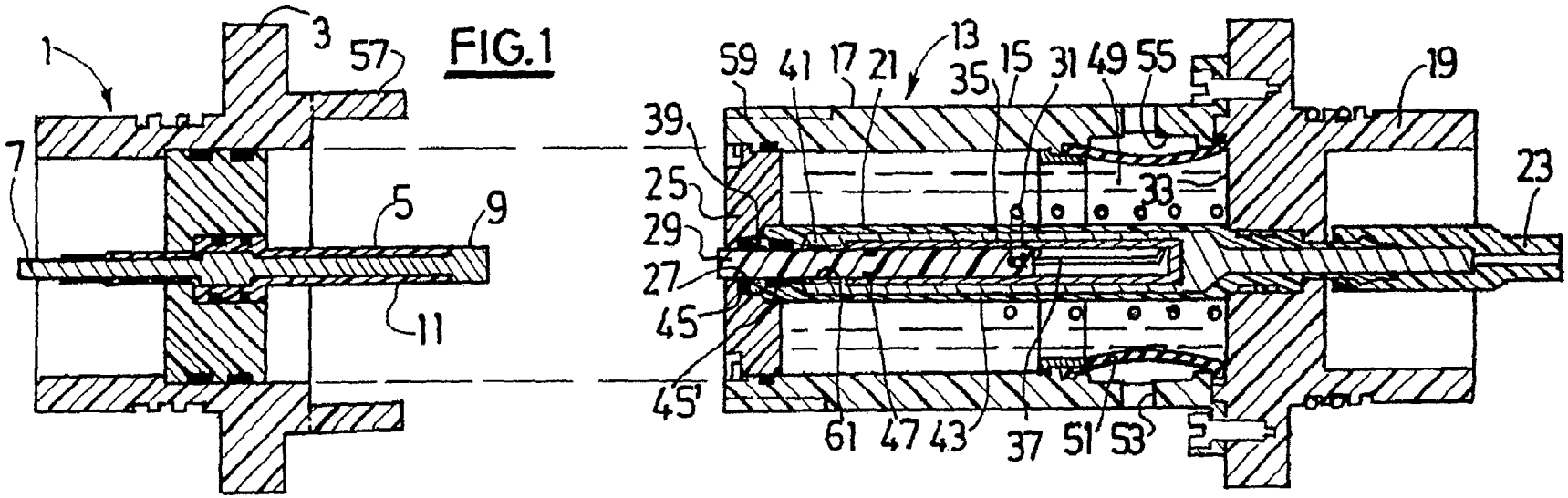
FIG. 1 is an axial cross-sectional view of a connector according to the invention in the uncoupled position.

The electrical connector according to the invention represented in the drawing comprises two complementary connector elements, designed to be coupled in service to each other, respectively a male connector element 1 and a female connector element 13.

It has an axial symmetry.

The male connector element 1 has a simplified structure, mainly comprising a casing 3 axially housing a cylindrical contact pin 5, fixed projecting toward the front and linked to a rear electrical cable 7. This pin has a circular section, but can be of any other shape, preferably rounded, even polygonal.

The pin 5 comprises a conductive part 9 at the end of its front peripheral surface, the rest of its surface being sheathed with electrically insulating material 11.

The female connector element 13 also comprises a body part or rigid casing 15 of section similar to that of the male element 1, this body part comprising two parts, respectively front 17 and rear 19, joined together by screws.

A contact chamber 21 is fitted axially between said front body part 17 and rear body part 19, being linked to an electrically conductive cable 23. This chamber 21 is fitted on the body part 19 and on the front face 25 of the body part 17, the latter having a circular front axial opening 27, of section complementing that of the pin 5 plus the passage clearance.

This opening 27 is arranged at the front of the chamber 21, a short distance from the latter. It is closed by a piston element or shuttle 29, of cylindrical configuration, fitted to slide axially in the contact chamber 21. This electrically insulating piston element 29 is returned toward the front, to the level of the opening 27, by a rear helical spring 31, linked to the rear end of the piston element 29 and bearing on the front face 33 of the rear body part 19. The spring 31 is fitted around the contact chamber 21, its front strand 35 passing through the contact chamber 21 through an axial slot 37 of a length equal to that of the travel of the piston element.

The piston element 29, the contact area, the contact chamber 21 in its part behind the piston and the interior of the front connector part 17 are filled with an electrically insulating fluid, and in particular electrically insulating oil, which is naturally water-repellent, promoting the freedom of the sliding motion of the piston element in the contact chamber.

The piston element 29 is in communication by its front end part with the insulating oil circulating in an annular chamber 39 formed at the front of the contact chamber 21 in the front face 25 of the connector element, and by its rear part with the insulating oil in the contact chamber 21.

This contact chamber 21 comprises an active internal conductive part 41 in its front part, which complements that 9 of the pin of the male element, the rest of its surface being covered with an electrically insulating sheath 43.

The piston element 29 is dried of all traces of surrounding fluid when it slides through the bore of the contact chamber 21 by means of two front annular seals 45, 45' and a rear annular seal 47 fitted on its periphery, midway along the latter, and behind the conductive area 41.

The first seal 45 of the front set is fixed on the front face 25 of the connector, the second 45' being fixed inside the front part of the contact chamber 21.

These seals are flexible lip seals or ring seals rubbing on the surface of the piston element 29. Thus, the latter, in the course of its sliding travel, frees the conductive area 41 of the contact chamber of all traces of external fluid (sea water) that could adversely affect the good contact of the contact areas that are in contact, respectively 9, 41 with the pin and of the contact chamber, when the connector elements 1 and 13 are coupled, this area remaining filled with electrically insulating oil that is neutral to the contact.

The seals 45' and 47 have the more specific effect of separating the contact area from the rest of the connector, so forming an additional sealing barrier with respect to any external polluting fluid that could penetrate into the connector.

The variation of internal volume inside the female connector element, contained by the insulating fluid 49, is compensated by a flexible elastomer element 51 positioned at the rear of the front body part 17 and just under its periphery over a small width. This flexible element 51 takes the form of a deformable sleeve, fixed in a sealed manner by its edges respectively on a corresponding recess of the front body part 17, and a complementary recess of the rear body part 19. This flexible element is in communication with the external fluid 49 (sea water) by means of peripheral holes 53 formed in the wall of the underlying recess 55 in the front body part 17 and its wall is able to deform in this recessed space 55. It can be exchanged when worn by separating the body parts 17 and 19.

There now follows a description of how the connector operates.

The pin 5 of the male connector element simply plugs into the opening 27 in the front of the female connector element, the pin 5 pushing the piston element 29 inside the contact chamber, against the return of the spring 31. The flexible element 51 is deformed outward to take up the increase in volume induced by the introduction of the pin. In this operation, the piston element 29 is wiped dry by the seals described previously, as is the pin 5 when it passes over the front seals 45, 45'.

The plugging-in is guided by a toe piece 57 projecting around the periphery of the front face of the male element, sliding into a complementary peripheral longitudinal groove 59 in the body of the female element.

Figure 2:
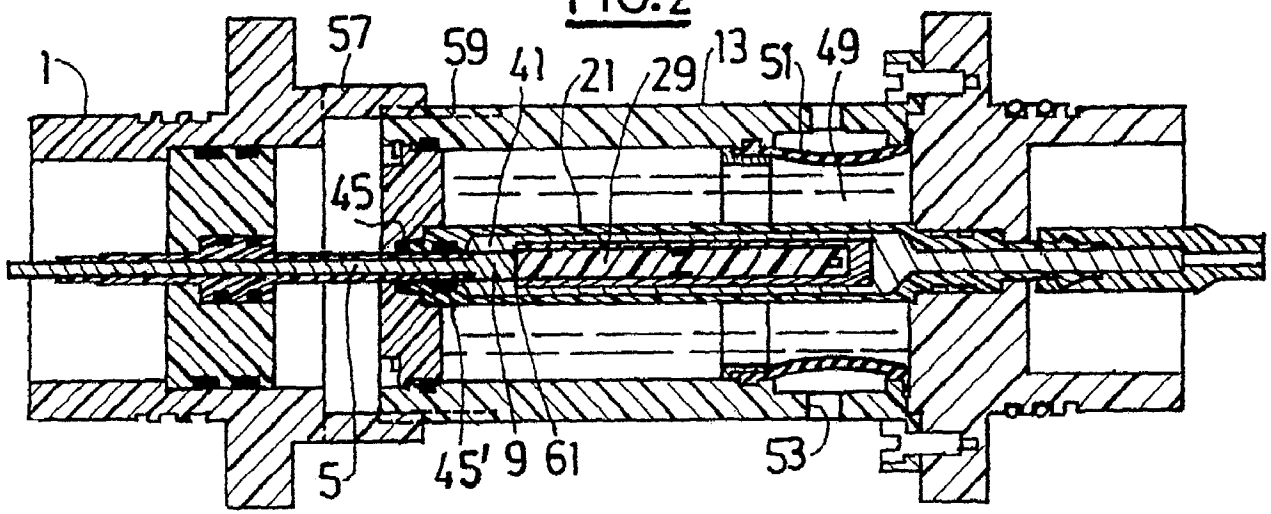
FIG. 2 is a view similar to FIG. 1, showing the connector in the coupled position.
Figure 3:
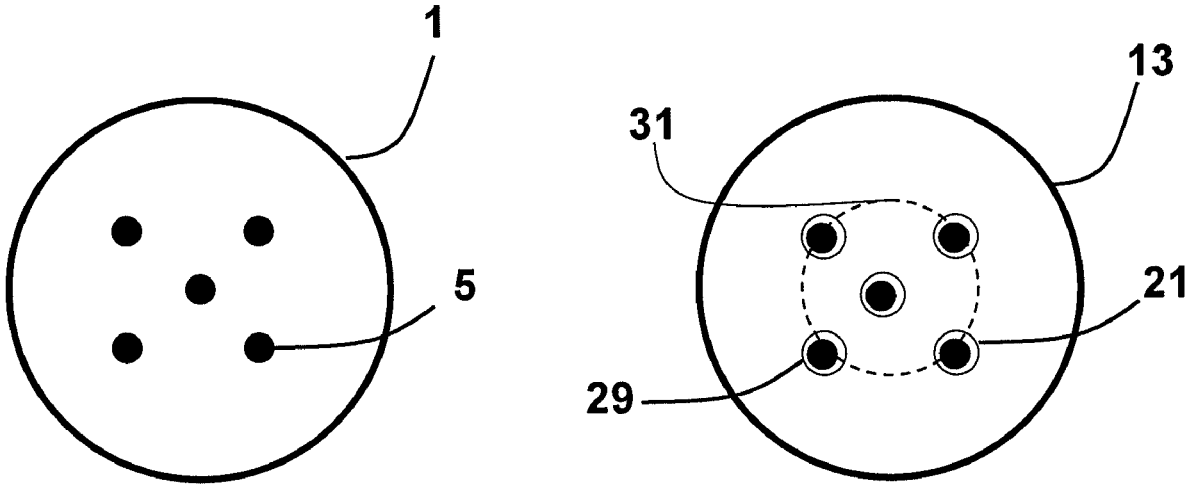
FIG. 3 is a schematic illustration of multiple contacts in a connector according to the invention.

At the end of travel (FIG. 2), when the male element 1 and female element 13 are abutting, the contact area 9 of the pin, cleared of all traces of polluting external medium, is received perfectly by the corresponding contact area 41 of the contact chamber, the cells 61 of the latter applying clamping pressure on the smooth conductive part 9 of the pin.

The connector elements are uncoupled by an extraction operation that is the reverse of the coupling operation, the piston element 29 then returning to the level of the opening 27.

The invention claimed is:

1. An electrical connector connectable in water or in a liquid medium, comprising two complementary connector elements, respectively a male element (1) and a female element (13) configured to be coupled together in service in said liquid medium, the male connector element (1) comprising at least one contact pin (5) projecting from the male connector element, and the female connector element (13) comprising at least one opening (27) for the pin (5) to pass through to couple said connector elements, the opening (27) blocked, in the uncoupled position, by an electrically insulating piston element (29) fitted to slide inside the female connector element in an electrically insulating rigid contact chamber (21), which receives via a contact area (41) the contact pin (5) of the male connector element on coupling, the piston element (29) and the contact pin (5) also sliding in a sealed manner on coupling into the contact chamber (21) via at least two axially separate seals, one seal (45) located close to said opening (27) and the second seal (45') located downstream of the contact area (9, 41) of the pin and of the contact chamber with respect to the opening (27), the surface of the piston element (29) between the two seals (45, 45') linked to a chamber filled with electrically insulating fluid (49), formed inside the connector element, the chamber linked to an external flexible wall element (51) that deforms to accept the insertion or removal of the contact pin (5) into or from the contact chamber (21), in respective connector coupling and uncoupling operations, the contact area also filled with electrically insulating fluid and separated from the rest of the connector by a third seal (47) provided on the piston element (29) or in the contact chamber (21), a rear part of the contact chamber (21), behind the piston element (29), also filled with electrically insulating fluid via an appropriate hole through a wall of the contact chamber, and said third seal element (47) separating the contact area filled with electrically insulating fluid from the contact chamber, so to avoid any trace of water or of polluting external liquid medium in the contact area (9, 41) on coupling; wherein said third seal is located on an axial side of said contact area opposite said at least two axially separate seals.

2. The electrical connector as claimed in claim 1, characterized in that the female connector element (13) comprises a rigid external body (17, 19) made of material that is insensitive to solvents.

3. The electrical connector as claimed in claim 1, characterized in that the deformable flexible element (51) is mounted so as to be replaceable.

4. The electrical connector as claimed in claim 1, characterized in that the contact pin (5) of the male connector element (1) comprises a conductive part (9) at a front end of the male connector element, the rest of the contact pin sheathed with electrically insulating material (11) and, similarly, the contact chamber (21) comprises an active internal conductive part (41) in a front part of the contact chamber, complementing that of the pin (5), the rest covered with electrically insulating material (43).

5. The electrical connector as claimed in claim 4, characterized in that the conductive part (41) of the contact chamber receives, in service, when the connector elements are coupled, the pin (5) through a set of annular cells (61) clamped on the pin(5).

6. The electrical connector as claimed in claim 1, characterized in that the piston element (29) is returned towards a front of the female element, at the edge of the opening (27) of the connector element, by a spring (31) positioned at a rear of the piston element (29) around the contact chamber (21).

7. The electrical connector as claimed in claim 6, characterized in that the spring (31) serves to return other piston elements (29) of contact chambers (21) of other contacts arranged in the connector element (13), in the case of connectors with multiple contacts (5, 21).

8. The electrical connector as claimed in claim 6, characterized in that said spring (31) is a helical spring linked to the rear end of the piston element (29) and bearing on a rear part of the connector body (13), the spring (31) fitted around the contact chamber (21), a front strand (35) of the spring passing through the contact chamber (21) through an axial slot (37) of a length equal to that of the travel of the piston element (29).

9. The electrical connector as claimed in claim 1, characterized in that said flexible element (51) takes the form of a deformable sleeve, fixed by edges of the flexible element in a sealed manner to the connector body, and in communication with the external fluid (49) by peripheral holes (53) formed in the wall of an underlying recess (55) in the external body (17) and the flexible element deformable in said recess (55).

10. An electrical connector, comprising:

a male connector element, comprising a contact pin projecting from a front of the male connector element;

a female connector element configured to be coupled to the male connector while in a liquid medium, the female connector element comprising:

an opening for the pin to pass through to electrically couple the connector elements;

an electrically insulating rigid contact chamber comprising an internal contact area and an insulating piston element slidable inside the contact chamber and blocking the opening in the uncoupled position, the contact area configured to receive and make electrical contact with the contact pin of the male connector element on coupling;

wherein the piston element and the contact pin are slidable in a sealed manner on coupling into the contact chamber via at least a first seal and a second seal, the first seal located close to the opening and the second seal located between the opening and the contact area of the pin;

wherein the surface of the piston element between the two seals being linked to a chamber filled with electrically insulating fluid and formed inside the connector element, the chamber linked to an external flexible wall element that deforms as a result of insertion or removal of the contact pin into or from the contact chamber, the contact area also filled with electrically insulating fluid and separated from the rest of the connector by a third seal located in the contact chamber on an axial side of the contact area opposite the second seal; and wherein a rear part of the contact chamber, behind the piston element, is filled with electrically insulating fluid via an opening in the contact chamber.

11. The connector according to claim 10, wherein the third seal is on the piston element and moves with the piston.

12. The connector according to claim 10, further comprising a spring biasing the piston element toward the opening.

13. The connector according to claim 12, wherein the spring is housed in the chamber filled with electrically insulating fluid.

14. The connector according to claim 12, wherein the flexible wall extends around the spring.

* * * * *